US006138921A

United States Patent [19]

Espinosa

[11] Patent Number: 6,138,921

[45] Date of Patent: Oct. 31, 2000

[54] MECHANISM FOR SECURING RAILS OF RAILWAYS ON WOODEN SLEEPERS

[76] Inventor: D. Jesus Moreno Espinosa, Ubanizacion Los Cerros C/Cerro de la Tarjeta, 9-E, 41089 Sevilla, Spain

[21] Appl. No.: 09/142,075

[22] PCT Filed: Dec. 23, 1997

[86] PCT No.: PCT/ES97/00312

§ 371 Date: Sep. 1, 1998

§ 102(e) Date: Sep. 1, 1998

[87] PCT Pub. No.: WO98/29606

PCT Pub. Date: Jul. 9, 1998

[51] Int. Cl.[7] ..... E01B 9/60

[52] U.S. Cl. ..... 238/334; 238/310; 238/324; 238/340; 238/361

[58] Field of Search ..... 238/310, 314, 238/317, 316, 321, 322, 323, 324, 327, 328, 334, 336, 340, 341, 355, 356, 357, 361, 362, 365

[56] References Cited

U.S. PATENT DOCUMENTS

| | | | |
|---|---|---|---|
| 1,346,965 | 7/1920 | Kehn . | |
| 1,531,927 | 3/1925 | Hamilton . | |
| 1,818,145 | 8/1931 | Macneir | 238/317 |
| 2,096,775 | 10/1937 | Woodings . | |
| 2,167,864 | 8/1939 | Bailey . | |
| 2,911,154 | 11/1959 | Cushman | 238/314 |
| 4,216,904 | 8/1980 | Vivion | 238/25 |
| 4,327,865 | 5/1982 | Greene . | |
| 4,454,985 | 6/1984 | Carter . | |

OTHER PUBLICATIONS

International Search Report dated Apr. 14, 1998.

*Primary Examiner*—S. Joseph Morano
*Assistant Examiner*—Frantz Jules
*Attorney, Agent, or Firm*—Blank Rome Comisky & McCauley LLP

[57] ABSTRACT

A rail-to-wood sleeper fastening mechanism in railroads, consisted of a clamp having an upper and middle branch fixed to the lower face of a sleeper, and with a pair of lateral and hinged branches, constituting the clamp, going through the sleeper via chimneys, and presenting upper and bent ends, sliding on the upper face of a foot of a rail, when respective wedges are inserted into said chimneys, that can be optionally configured by establishing a hinged union which is removable between the side branches of the clamp and its lower and middle branch, so that said side branches are easily installed and removed.

9 Claims, 7 Drawing Sheets

FIG. 5
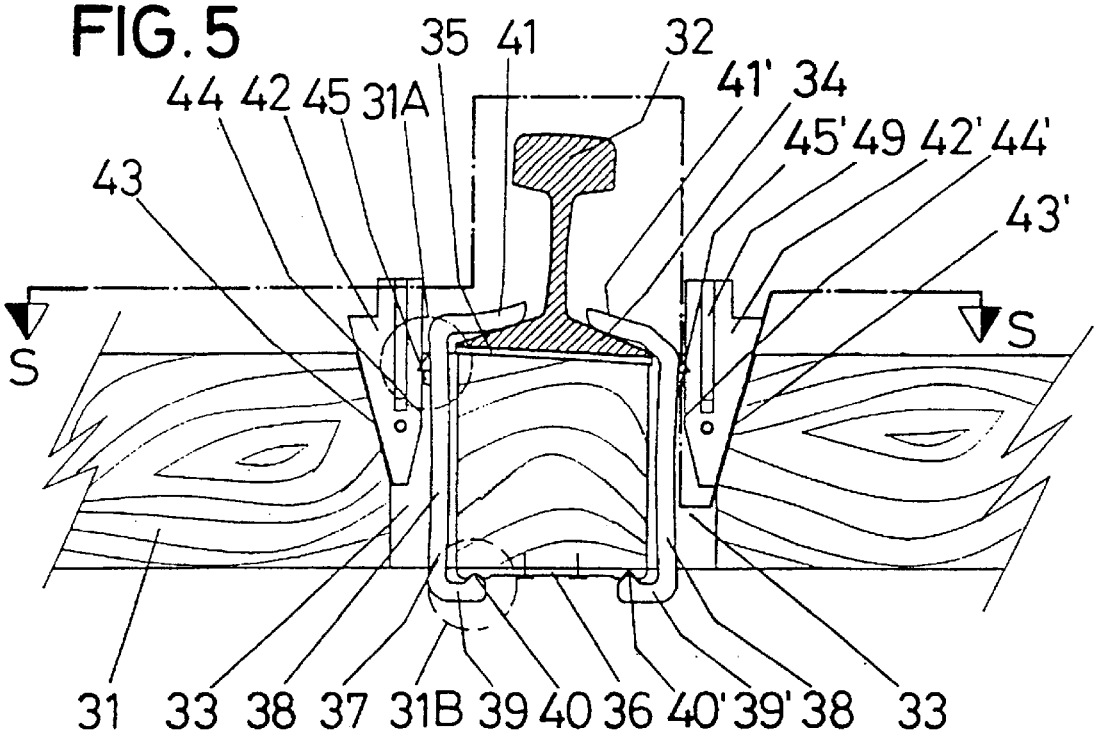
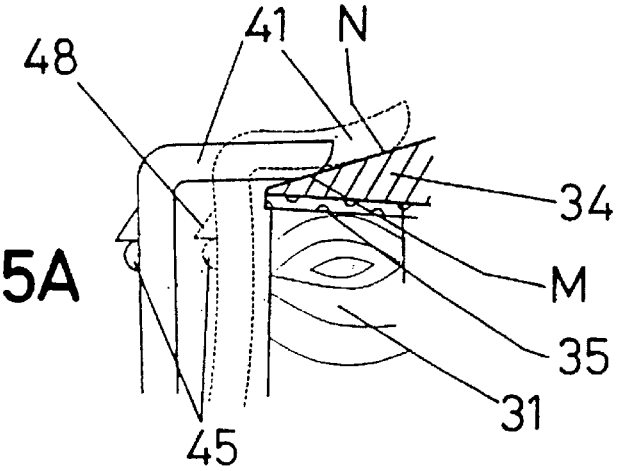
FIG. 5A
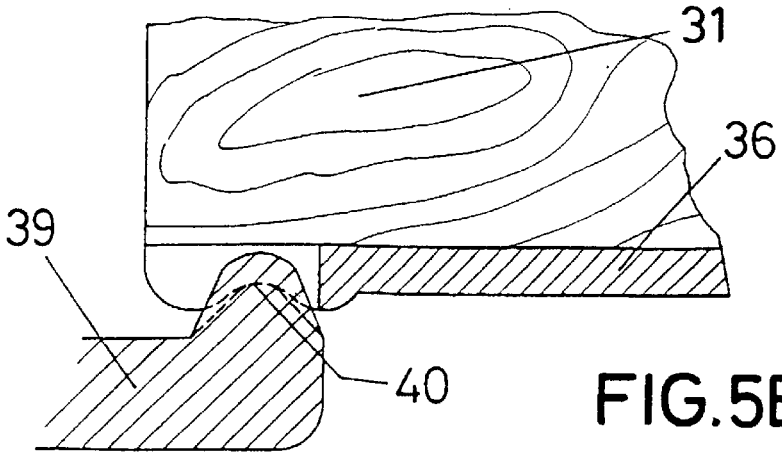
FIG. 5B

S-S'

T-T'

MECHANISM FOR SECURING RAILS OF RAILWAYS ON WOODEN SLEEPERS

BACKGROUND OF THE INVENTION

The present specification refers to a mechanism for fastening each rail of a railroad to sleepers supporting it, in the specific case that said sleepers are made of wood, as in railways still out-of-date owing to their limited traffic, in railway lines in developing countries, and, in general, where minimal maintenance costs are essential, without impairing very good performances in the type of traffic they render for example, in case of exclusive goods service.

The mechanism of the invention performs an elastic fastening of the rail to a sleeper, having a parallel wedging effect, and secures a very good fastening, in addition to a series of complementary advantages which will be enumarated along the present description.

Also, this invention contemplates aspects of this mechanism making easy its implantation and maintenance.

1. Field of the Invention

This invention will find application in the industry devoted to railways.

2. Related Art

Although there is, at present, a more advanced technology than the utilization of the traditional wood sleepers for making up a railway, due to economical reasons said wood sleepers are still being used, both in developing countries, where the investment standing is limited, as well as their technological capacity, and in developed countries, in this case in railways where investments for replacing wood sleepers by others more modern would be scantily profitable, and, then, the railway maintenance costs are too much high.

To date, for fastening a rail to the corresponding wood sleepers, nailing systems are used, by friction or by threading, so that both vibrations and the unitary forces, mainly those horizontal, acting on the rails when passing the trains, are transmitted, through said nailing means, to the sleeper holes involved.

Furthermore, said elements, already when being nailed into the holes, have a tendency towards splitting the wood and causing fissures, in which dampness due to the rain water, which favours corrosion effects, accumulates, and also an evident nailing slackening is produced, causing the track grid to grow weak.

This gradual slackening of anchorages compels to a constant maintenance under the supervision of skilled staff the costs of whose are very high.

SUMMARY OF THE INVENTION

The mechanism as proposed by the invention solves, in a fully satisfactory manner, the above mentioned problems, performing a very quick, simple and efficient fastening of rails to sleepers, which does not require any skilled staff, and it keeps indefinitely the original fastening level by means of a minimal maintenance, which is very inferior to that conventionally required.

This invention also contemplates aspects of the mechanism which facilitate both the implantation and the maintenance of same.

So then, and in a most definite way, the rail-to-wood sleeper fastening mechanism in railroads as proposed by the invention, starts from the wood carving of a sleeper, at each side of the implantation zone of the rail, of both chimneys designed to allow side branches of a sleeper to pass, in which a lower branche takes part, prefixed by nailing to the lower face of the sleeper, between the two chimneys, and to the ends of which the lateral and falling branches constituting the own clamp, are articulatedly united, which have an extreme upper and bent sector designed to be adapted to the upper face of the rail foot, this fastening being carried out with the collaboration of a pair of wedges inserted into the corresponding chimneys, the insertion of which tends to choke the clamp against the rail with elastic distortion of the side branches, so that the end sectors exert a constant pressure on the rail foot and the correlative one of this on the upper face of the sleeper.

According to other characteristic of the invention, and in order to avoid a discoupling of the wedges, it has been envisaged that these ones incorporate in their inner face a cogged bar coupled to a hook suitably fixed to the external face and corresponding of the sleeper, both cog and ratchet being adequately configured to facilitated the feed motion of the wedge and its housing, and to prevent an incidental discoupling.

Said cogged bar, housed in a middle and vertical groove of the wedge, tends to be permanently directed out by means of a spring which is also housed in the wedge cavity, so that the disassembly of the wedge and consequently of the clamp, is only feasible after a deliberate strain of said spring in the direction of the discoupling of the cogged bar with regard to the hook.

A pair of lateral and vertical guides assure a perfect displacement or advance of the wedge when assembling same knocking it.

According to other characteristic of the invention, the wedge incorporates in its back adaptation face to the wood of the sleeper, sharp ribs, of increasing section in an upward sense, which generate respective scores on the wood according the wedge advances, acting also as guides for same.

Starting from a basic structure for the rail-to-wood sleeper fastening mechanism in railroads, one of the improvements that this can optionally present is centred on the fact that the side bands of the clamp, instead of being hinged on the middle branch, are physically independent of the middle branch, the hinge system having complementary channeling and ribs establishing a hinged union, but easily disassembled, which allows, at the same time, any of said side branches to be easily uncoupled by slightly raising the sleeper.

In that sense, the centre of the grooves of the ends of the middle branch of the clamp remains hollow, and inside it a projection emerging from each of the ribs placed at the end of the side branches, is housed, in order to lock them axially against every motion tending to displace them, such as that caused by ballasting works.

In accordance with other characteristic of the invention, the side wedges have an external stepped recess reducing the knocking zone when inserting same, this being the most suitable manner to obtain a very good insertion of the wedge.

According to other characteristic of the invention, it has been envisaged that the tracks for the wedge be inserted into the own side branches of the wedge, with which the oblique edges of same collaborate when being nailed on the sleeper wood.

It has been also envisaged that both the wedge hooks on which the cogged bar acts, and the stops or stubs of the former establishing a precise contact for the wedge when this slides, form a part of the own side branches of the clamp thru welding or any other suitable method, so the anticipated auxiliary support or part being obviated.

In accordance with other characteristic of the invention, it has been provided, at the inner branch of the clamp, and most specifically at the upper and bent end of same, a blunt inflexion avoiding possible cases, although not much probable, in which the foot tries to turn about its external edge.

Lastly, it has been envisaged that the wedge relies on a top closing cover hiding the internal mechanisms, and which requires a great effort to be opened and that consequently protects said mechanisms from vandalism and other similar actions.

DESCRIPTION OF THE DRAWINGS

In order to complement this description and aid to a better understanding of the characteristics of the invention, the appending drawings, which area part of this specification, show, by way of illustrative and non-limiting example, the following:

FIG. 5 shows, according to a schematic cross sectional view of the track, a rail clamped to its corresponding sleeper, only represented in a zone around the union zone, by means of an integration mechanism.

FIG. 5A shows a detail of FIG. 5, illustrating graphically the manner in which a system for tightening a rail against a sleeper acts, forcing the advance of the end of the clamp from point M to point N.

FIG. 5B shows, thru a sectional view crossing the clamp shaft, the manner of materializing the lower hinge of the clamp on the end of a plate nailed to the lower face of the sleeper, so that it can withstand ballasting effects, and it allows the clamp to be easily implanted and removed from the upper face of the sleeper.

DESCRIPTION OF THE PREFERRED EMBODIMENT(S)

Figure 1:
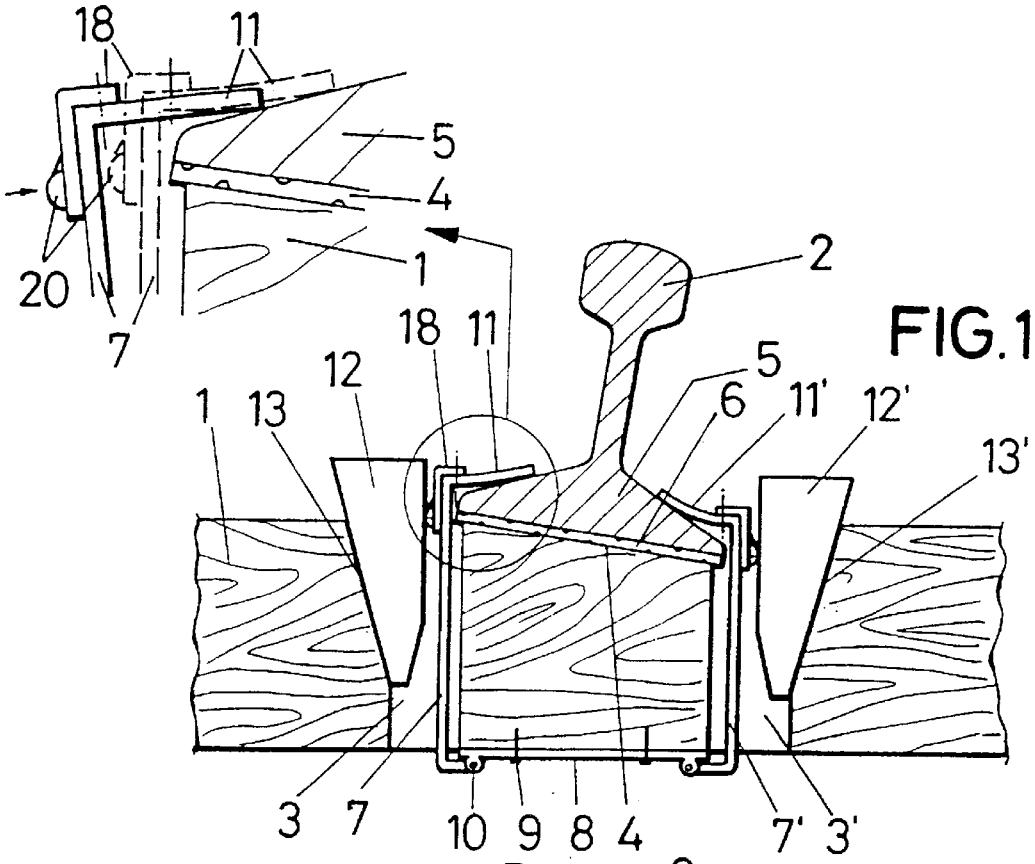
FIG. 1 shows, according to a schematic cross sectional view, a rail coupled to its corresponding sleeper by means of the fastening mechanism which is the object of the present invention, the sleeper being represented only partly.

From the FIGS. 1, 2, 3 and 4, and more specifically, from FIG. 1, it can be seen that the rail-to-wood sleeper fastening mechanism in railroads as proposed by the invention, starts from the provision on a sleeper (1), and in correspondence with the seating zone of a rail (2), of a pair of chimneys (3–3'), around the zone (4) of the sleeper on which the base (5) of a rail (2) is to be seated, with the insertion of a rubber plate (6).

These chimneys (3–3') are adequately sized to allow side branches (7–7') of a clamp (8) to pass thru same from the upper face of the sleeper (1), which thru its lower branch, in correspondence with the own reference (8), is fastenen to the lower face of the sleeper (1), between both chimneys (3–3'), in collaboration with nails (9), although in a provisional way, since its final fastening is determined by the own tightening of the clamp.

To the ends of the lower face (8) of the clamp, said side branches (7) are united through hinges, these side branches constituting the own clamp, which, at their upper end, are topped by means of extreme bent ends (11–11') designed to put pressure on the upper face of the rail (2) foot (5). The side branches (7–7') of the clamp can be symmetrical when the rail adopts a perfect vertical position, or they can be asymmetrical, as in the example represented in FIG. 1, when it is a question of days, where the rail position (2) is inclined.

In any case, the clamp closing on the foot (5) of the rail (2), pressing it against the sleeper (1), is performed in collaboration with a pair de wedges (12–12') pressure-fitted in the cavity of the respective chimneys (3–3'), to which end the later have inclined planes (13–13') on which a wedging effect is produced, given rise to an elastic deformation of the assembly of each side branch of the clamp, such as is specially seen in the detail of FIG. 1, where a solid line represents the original position of the clamp before being tightened, and an intermittent line shows the final position, after being tightened due to the wedging effect.

Figure 3:
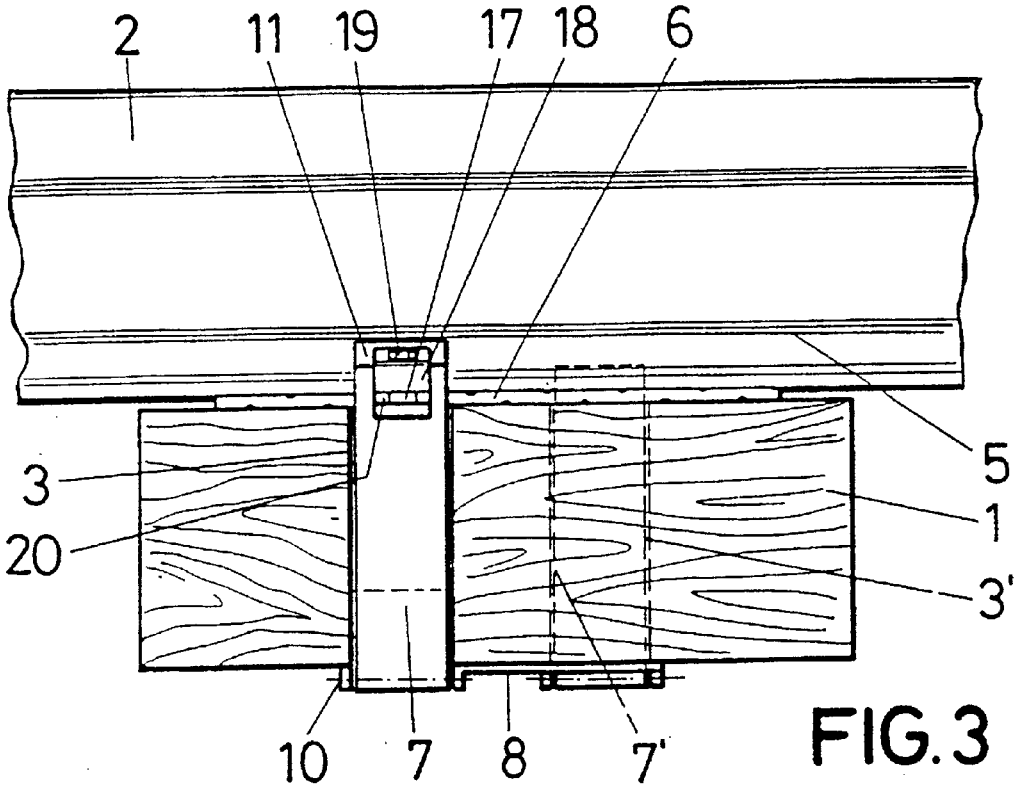
FIG. 3 shows another enlarged detail of the assembly illustrated in FIG. 1, specifically on a level of the hinged union of one of the side branches of the clamp with its lower and middle branch.
Figure 4:
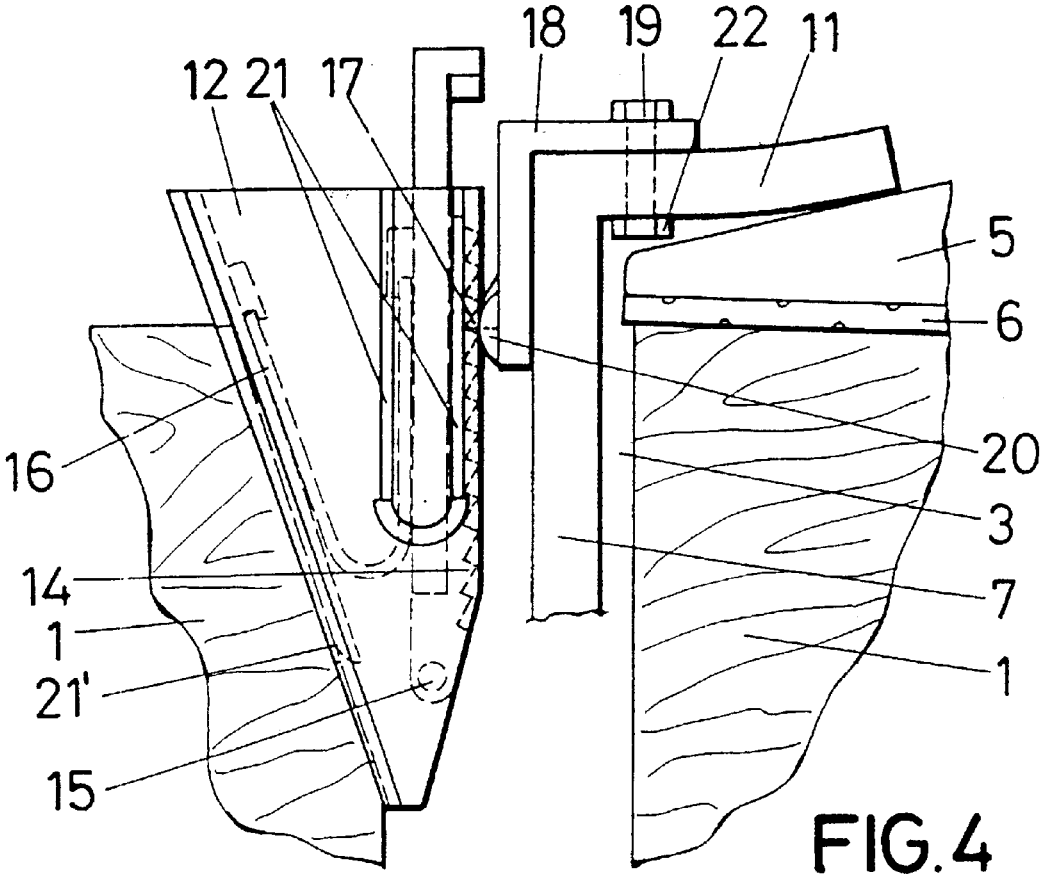
FIG. 4 corresponds to other enlarged detail of FIG. 1, specifically corresponding to the wedge thrust on the side branch of the clamp, and to the wedge retaining system by the ratchet-clamp wedge assembly.
Figure 6:
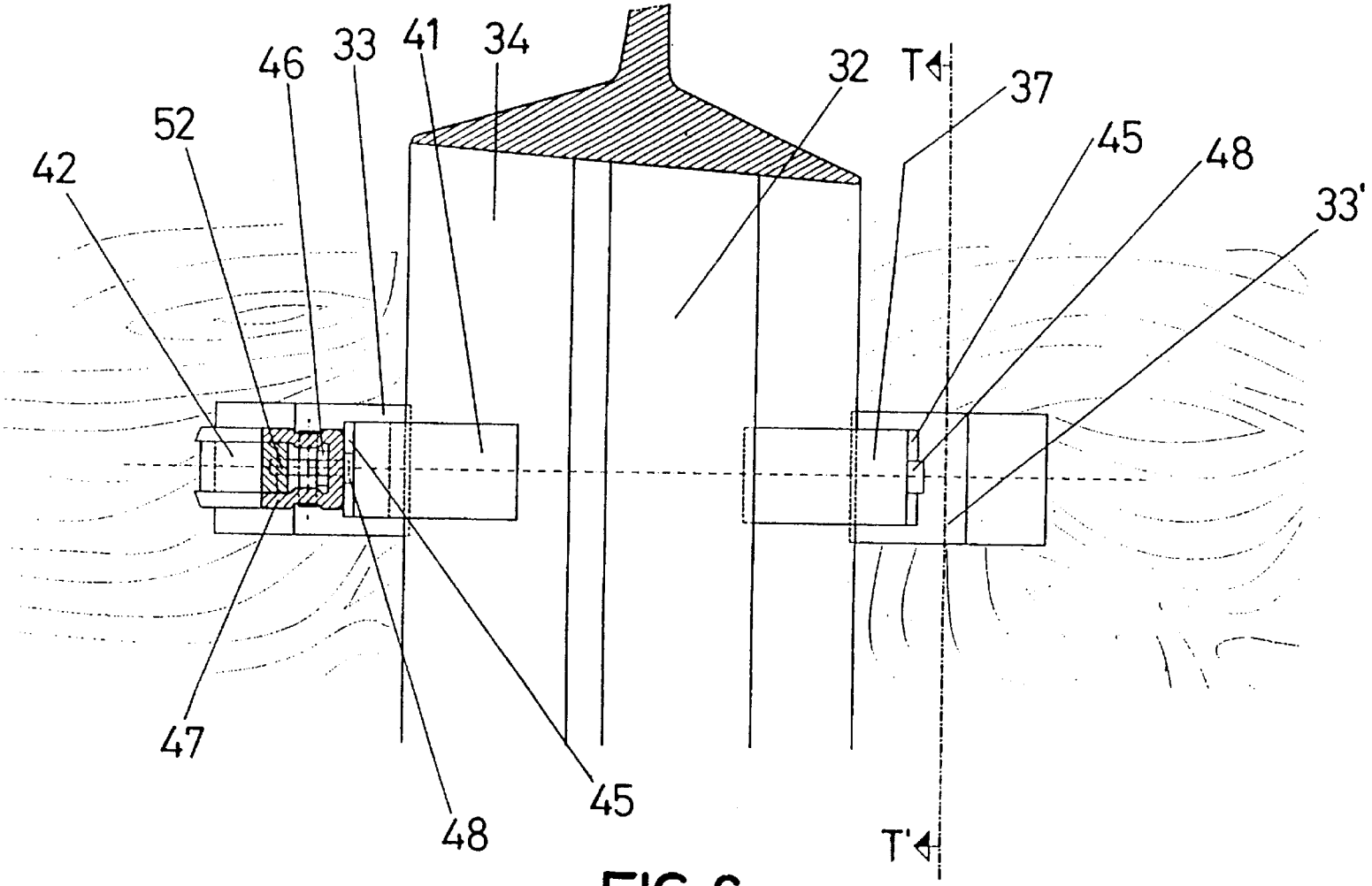
FIG. 6 shows a plan view of FIG. 5, illustrating the left side of the full mechanism, and only the right side of the clamp.
Figure 7:
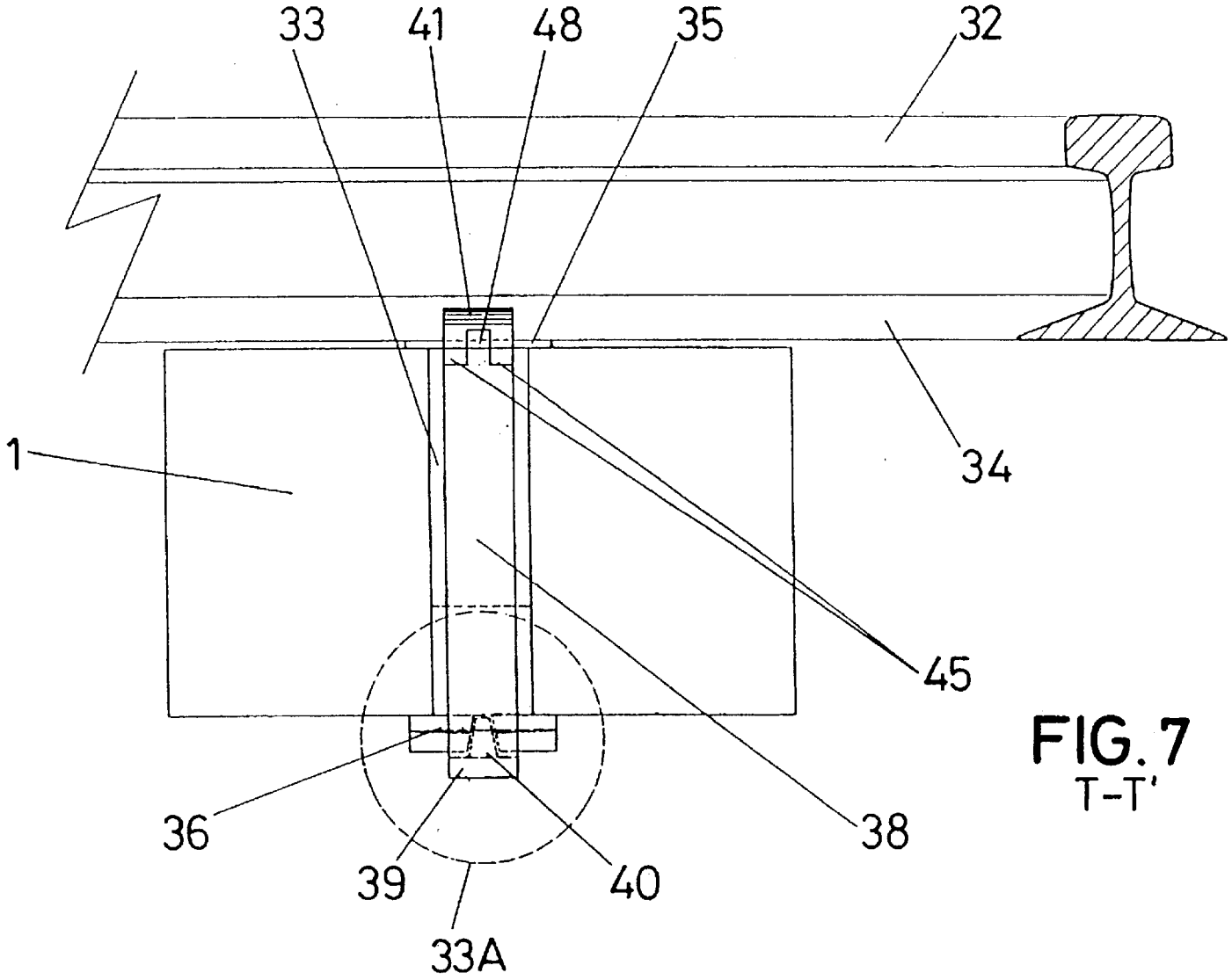
FIG. 7 corresponds to a section longitudinal to the sleeper thru the chimney, where the clamp is seen, without the presence of the respective wedge.

Although the wedges (12) can be of any type, it has been envisaged that, such as represented in FIG. 3, said wedges (12) will present a wide vertical and middle groove, in which a cogged bar (14) operates, which is tiltably mounted thru its lower end and by means of a pin (15) on the own wedge (12), said cogged bar (14) tending to being permanently directed out by means of spring (16), also housed in the cavity of said groove, and in collaboration with the cogged bar (14), a hook (17) belonging to the clamp (7).

Figure 2:
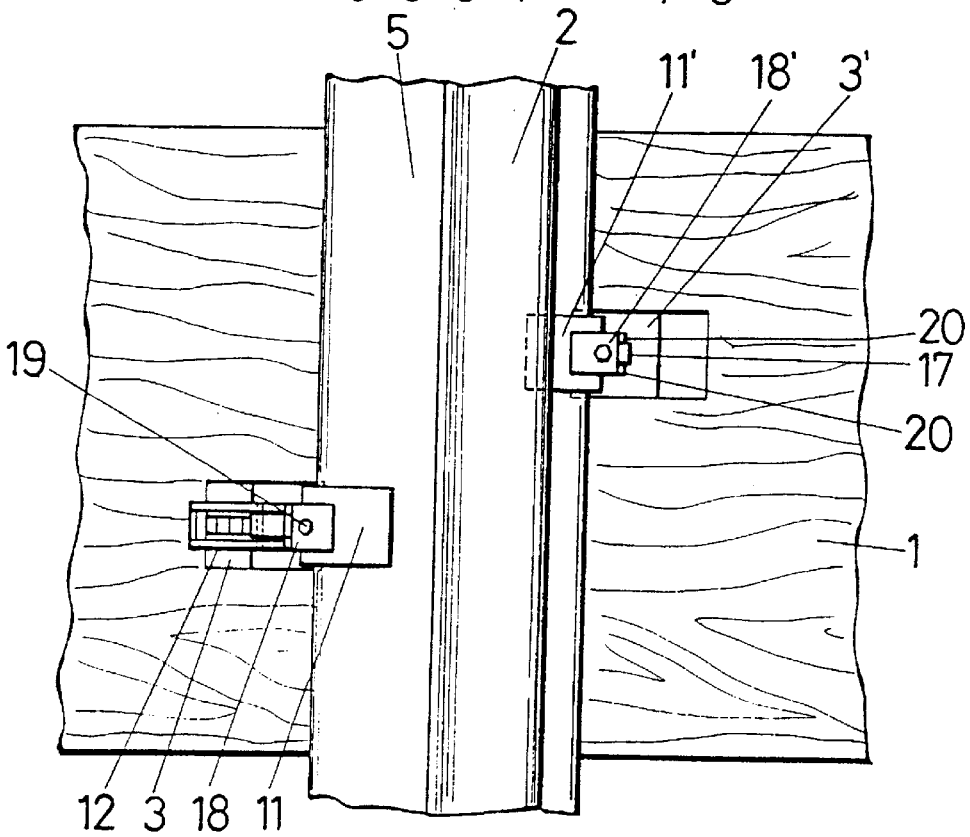
FIG. 2 shows an enlarged detail of FIG. 1, or a level of one of the mechanism wedges.

In accordance with a practical example of preferred embodiment of the invention, and such as is shown in FIG. 2, said hook (17) is not directly located on the clamp (7), but on an auxiliary part (18) screwed (19) to the clamp (7), and, furthermore, said hook (17), and at both sides of same, incorporates a pair of buttons or rounded stubs (20), through which a precise contact between the wedge (12) and the clamp (7) is established, and through same a pressure from the former to the later is transmitted.

In order to ensure a perfect guiding of wedges (12) during the wedging operation, which preferably should be simultaneous on both wedges (12–12'), it has been envisaged that each of them incorporates guiding ribs (21) on their side faces, which run in vertical grooves that they are shaping on the own walls of the sleeper (1), when the wedge advances.

Besides, on the external face of said wedges (12–12'), there are also longitudinal ribs (21'), of section gradually decreasing in downward sense, which penetrate also into the corresponding face of the chimney (3) of the sleeper (1).

The cogged bar (14) and a complementary cog (17) are properly configured to facilitate a jump of one over other in the normal advance motion of the wedge, and this wedging effect remains invariable along the time, inasmuch as it is absolutely impossible an incidental uncoupling of the cogged bar, since for it, it would be necessary to overcome the spring tension (16), for which a force of the order of 200 kg has been anticipate, with the complementary object of avoiding a possible theft of the wedge using normal tools, since it offers a high degree of dificulty to this end.

Lastly, it should be only pointed out that the nut (22) of the setscrew (19) for fixing the auxiliar part (18) to the clamp (7), acts simultaneously like a stop in the not much probable case that the transverse forces on the rail (2) will be so high that the tightening efforts of the clamps will not be sufficient for maintaining the rail foot contact on the rubber plate, counteracting and surpassing the momenta created.

Following FIGS. 5, 5A, 5B, 6, 7, 8 and 8A, and specially following FIG. 1, it can be seen that the rail-to-wood sleeper fastening mechanism in railroads starts from making, on a sleeper (31), and in correspondence with a rail seating zone (32), a pair of chimneys (33–33') marking the sleeper portion on which the rail foot (34) is to be seated, with the insertion of a rubber plate (35).

These chimneys (33–33') are adequately sized to allow the insertion, from the upper face of the sleeper (31) of the side branches (38–38') and upper branches (39–39') of a clamp (37), which, at the end (40–40') of its lower branch, hinges at the respective end of a steel plate (36), nailed to the lower face of the sleeper, between the two chimneys (33–33').

The rotation of each clamp around a turning shaft (40), located at the end of its lower branch, causes the end of its upper branch (41) to be displaced thru the upper face of the foot (34) of the rail (32), and, consequently, upon the elastic deformation of the clamp, a rail pressure (32) on the sleeper (1) is provoked due to the elastic reaction of the lower (40) and upper (41) ends of the clamp (37).

The closing of the clamps (37) on the foot (34) of the rail (32), is carried out thru the thrust of a pair of wedges (42–42'), which are impelled to be inserted into respective chimneys (33–33'), and to this purpose, these chimneys are fitted with inclined planes(43–43') on which the back of the wedges (42–42') slides, the front part of which (**44–44*n*) advances, pushing with its side walls, toward the ribs (45–45') incorporated to the clamp core (37), which, upon advancing, elastically becomes deformed as a whole, such as can be noted specially in the detail of FIG. 5A. A solid line represents the original position of the clamp (37**), before tightening it (with its upper end resting on M), and the intermittent line shows its final position after being tightened thru wedging (with its end resting on N).

Figure 8:
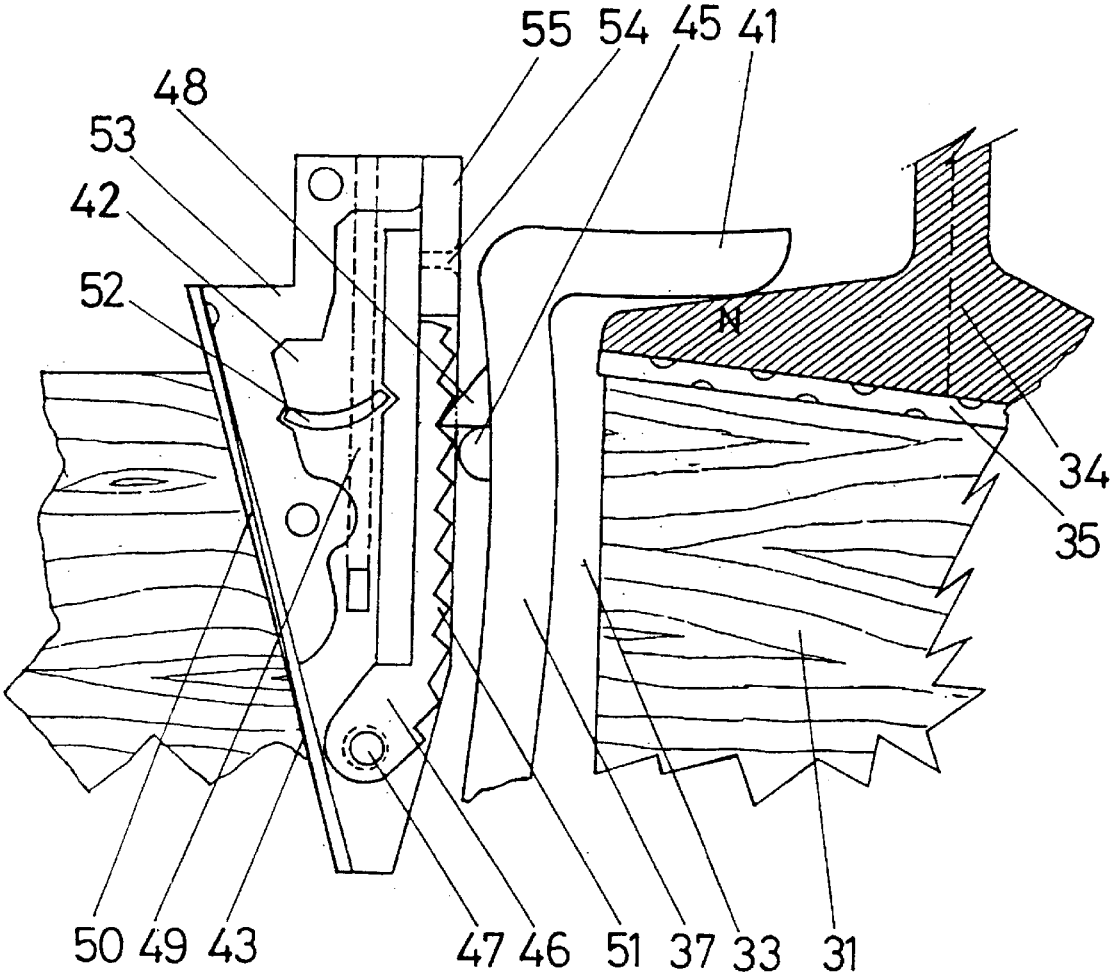
FIG. 8 shows other enlarged detail of FIG. 5, illustrating, specifically thru a sectional view through the symmetry axial plane of the hollow wedge, the wedge thrust system on the stubs of the clamp, and the wedge retaining system by means of a mutual fastening on the cogged bar-clamp wedge.
Figure 8A:
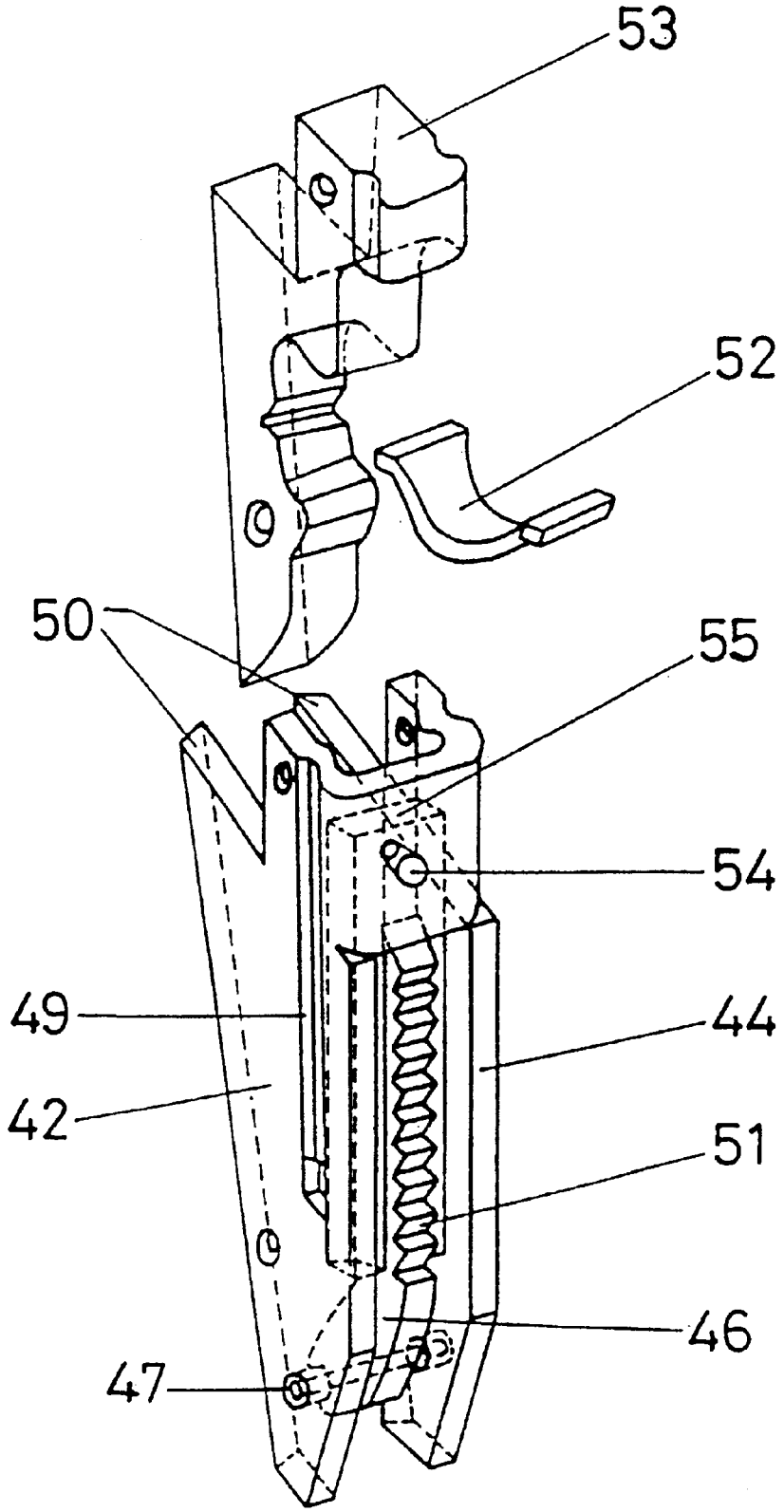
FIG. 8A shows, lastly, tridimensional representations of schematic type, in axonometric projection of the wedge, showing the faces concealing, at the upper side, the access to the ratchet elements, and that, in addition provide rigidity to the wedge assembly, and also of the clamp zone wherein the application of the wedge thrusts is performed.

Such as is shown in FIG. 8, the wedges (42) are hollow and present a central housing wherein a ratchet (46), mounted with turning shaft (47) on its lower end, rotates inside loose perforations made in the side faces of the wedges (42), said cogged bar being permanently pushed out thru the action of a strong spring (52), anchored at its front end in the cogged bar, and anchored at its back end on the inner surface of the back wall of the hollow wedge (42).

Under the pressure of the spring (52), the cog (51), corresponding to the ratchet (46), is applied, being mutually fastened against the wedge (48) belonging to the clamp (7).

To both sides of the wedge (48), and one centimeter below, a pair of cylindrical stubs (45) having a horizontal shaft, are incorporated in the clamp (37). These stubs precisely locate the action of the thrust force caused by the insertion of the wedge (42) on the clamp (37).

To ensure a perfect guiding of the wedges (42) during the wedging operation, which preferably must be simultaneous on both wedges (42–42'), guiding grooves (49) have been provided outside their side faces, and which are vertically gone through to achieve the vertical insertion of the wedge (42–42').

Furthermore, along the back face of the wedges (42–42'), there are small longitudinal ribs (50), having a gradually decreasing section in downward direction, which are nailed on the inclined face (43) of the chimney (33) of the sleeper (31), creating in it small incisions which will assist their guiding during the insertion of the wedges.

The cogs (51) of the cogged bar and the wedge (48) corresponding to the clamp (37) are adequately configured so that the jump of one over other will be facilitated in the normal advance motion of the wedge (42–42'), and instead the wedging effect will remain invariable along the time, so being impossible an incidental uncoupling of the cogged bar (46), since for it, it would be necessary to overcome, deliberately, the high force of the spring (52), for which it has been envisaged a force from 100 to 150 kg, with the complementary object that the parts of the system cannot be stolen with standard tools, on offering a high degree of difficulty to this end, as, also, there is a upper closing cover (53) for the wedge (42–42'), and the only access for unblocking the ratchet is a narrow hole (54), through the upper front closing element (55) of the wedge (42) or (42').

Lastly, it should be pointed out that, in the hardly probable case that the overturning forces cause momenta surpassing the stabilizers owing to the weight of the trains and to the clamp pressures, the clamp (37), on the inner side of the track, has, at its upper branch, a slit that, lowering its corner with the vertical branch, acts as a stop fastening the rail (32), which, eventially, tends to turn toward the exterior.

With the mechanism of the invention, and such as has been pointed out above, a series of advantages is obtained as contrasted with the conventional fastening systems to wood sleepers (31), which are fundamentally centred on the following aspects, namely:

To keep the rail tight against the sleeper, with the passage of time, and, in the rare case that it comes loose, it is very simply its recovery.

To drastically reduce the track maintenance costs: on the one hand, due to the fact that it is not necessary to replace those sleepers made useless owing to an aggresive fastening; on the other hand, on the basis of the savings in the replacement of materials of the fasteners; thirdly, there is no need to carry out adjusting operations (through the so-called retights) due to nail loosening, and, lastly, the possible joint elimination, since the increase of the rail-sleeper pessure of the warranty of its permanence creates conditions to allow, in cases, the track to be constructed trackless.

To possibly use the wood sleeper, available in a great majority of countries, under conditions of a very remarkable economy and reduction of costs necessary for maintenance of the guide.

Possibility of establishing and utilizing, in an economic way, railway lines in countries with technological standing scarcely advanced.

A very easy correction of the railway gage, and even the track alignment (that, anyway, they must not be altered than by deformation of the ballast bed).

A greater flexibility of the grid with wood sleepers and, therefore, a greater running comfort, in the case of tracks not very well maintained.

A full electric insulation between rails, without disturbances, and no need to take additional precautions to avoid them, of the track circuits.

Saving of the materials used: due to the extension of the life of the parts or elements of the invention, and owing to the possibility of using wood sleepers of second hand, and ballasts of low cost.

A track grid installation very simple, utilizing elements of easy application.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A rail-to-wood sleeper fastener for a railroad, comprising:

an elastic wedged clamp having a lower portion adapted to be fastened to a lower face of a sleeper, said clamp further having two side branches that are connected with said lower portion, each of said side branches extending through a corresponding one of a pair of chimneys in said sleeper, each of said side branches connected to top end bent portions adapted to contact an upper face of a foot of a rail;

a pair of hollow wedges each of the hollow wedges extending into the respective chimney in said sleeper and exerting pressure onto a corresponding one of said side branches, each of said hollow wedges including a cogged bar facing a corresponding one of said side branches, each cog of said cogged bar cooperating with a hook on a corresponding one of said side branches to allow each of said wedges to advance into a corresponding one of said chimneys and to resist the removal of said wedge from said corresponding chimney.

2. The fastener of claim 1, wherein each of said cogged bars is pivotally mounted on a transverse shaft in a groove of a corresponding one of said wedges and wherein each of said wedges further comprises a spring that biases said cogged bar toward said hook on a corresponding one of said side branches.

3. The fastener of claim 1, further comprising an auxiliary part attached by a screw to each of said clamps, said auxiliary part supporting said hook, said auxiliary part including stubs surrounding said hook, said hook adapted to receive said pressure from a corresponding one of said pair of wedges.

4. The fastener of claim 3, further comprising a nut retained on each of said screws on said clamps, each of said screws further serving as a stop for the foot of the rail.

5. The fastener of claim 1, wherein each of said pair of wedges includes external vertical ribs on side walls of said wedge and also include longitudinal ribs having a decreasing section as the longitudinal ribs extend downward.

6. The fastener of claim 1, wherein each of said side branches are detachably hinged to said lower portion through ribs on each of said side branches and complementary channels on said lower portion, said lower portion including an opening in a center zone in ends of said lower portion to accommodate said ribs and to longitudinally position each of said side branches with said lower portion.

7. The fastener of claim 1, wherein each of said pair of wedges includes a stepped recess that defines a knocking surface, wherein the center of said knocking surface is approximately positioned above the center of gravity of said wedge.

8. The fastener of claim 1, wherein each of said pair of wedges includes a cover and a frontal closing element adapted to receive a plier to unlock said hook from said cogged bar.

9. The fastener of claim 1, wherein a top end bent portion includes a blunt inflexion positioned near the foot of the rail.

* * * * *